US010568423B1

(12) United States Patent
McDowell et al.

(10) Patent No.: US 10,568,423 B1
(45) Date of Patent: Feb. 25, 2020

(54) DISPLAY UNIT WITH SHELF

(71) Applicant: Target Brands, Inc., Minneapolis, MN (US)

(72) Inventors: Daniel K. McDowell, Minneapolis, MN (US); William Y. Stafford, Minnetrista, MN (US); Ian Jindrich, Rockford, IL (US); Stanley J. Valiulis, Rockford, IL (US); Gabriel Garduno, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 16/130,064

(22) Filed: Sep. 13, 2018

(51) Int. Cl.

| | |
|---|---|
| ***A47B 57/04*** | (2006.01) |
| ***A47B 96/14*** | (2006.01) |
| ***A47B 95/00*** | (2006.01) |
| ***A47B 57/16*** | (2006.01) |
| ***A47B 46/00*** | (2006.01) |
| ***A47B 43/00*** | (2006.01) |

(52) U.S. Cl.
CPC ..... *A47B 57/045* (2013.01); *A47B 43/00* (2013.01); *A47B 46/00* (2013.01); *A47B 57/16* (2013.01); *A47B 95/008* (2013.01); *A47B 96/1408* (2013.01)

(58) Field of Classification Search
CPC ..... A47B 57/045; A47B 57/15; A47B 95/008; A47B 96/1408; A47B 46/00; A47B 57/04; A47B 43/04; A47B 45/00; A47B 47/022; A47B 96/027; A47B 43/00; A47B 47/00; A47B 47/02; A47B 47/021; A47B 53/00; A47B 55/00; A47B 55/02; A47B 57/00; A47F 5/12; A47F 5/16; A47F 5/08; A47F 5/10; A47F 5/0018; A47F 5/0043; A47F 5/01; A47F 5/101; A47F 5/103
USPC ..... 211/90.01, 90.02, 2, 150, 96, 99, 103, 211/187, 123, 88.04, 88.01; 248/235; 108/106–108, 115; 312/258, 262
See application file for complete search history.

(56) References Cited

U.S. PATENT DOCUMENTS

| | | | | | |
|---|---|---|---|---|---|
| 421,540 | A * | 2/1890 | Barber | A47F 5/116 | 211/132.1 |
| 510,427 | A * | 12/1893 | Hine | A47B 43/00 | 312/262 |
| 786,526 | A * | 4/1905 | Sollom | A47B 85/06 | 108/15 |
| 1,802,579 | A * | 4/1931 | Hilliard | A47B 75/00 | 209/244 |
| 2,315,595 | A * | 4/1943 | Chappory | A47F 5/13 | 211/186 |

(Continued)

*Primary Examiner* — Jennifer E. Novosad
(74) *Attorney, Agent, or Firm* — Leanne Taveggia Farrell; Westman, Champlin & Koehler, P.A.

(57) ABSTRACT

A display unit includes at least one shelf including a first side, an opposing second side, a pair of brackets and at least one hang bar that is mounted to and protrudes from the first side or the second side. The at least one shelf is configured in a first orientation or a second orientation. In the first orientation, the pair of brackets are configured to orient the first side to face in an upward direction and the opposing second side to face in a downward direction. In the second orientation, the pair of brackets are configured to orient the first side to face in a forward direction and the opposing second side to face in a backward direction.

20 Claims, 14 Drawing Sheets

(56) References Cited

U.S. PATENT DOCUMENTS 2,467,411 A * 4/1949 Tingdale ..... G09F 23/06 40/308
2,710,241 A 6/1955 Lieberman
2,868,391 A * 1/1959 Sides ..... A47F 5/13 211/133.5
2,919,034 A * 12/1959 Levy ..... A47B 57/045 108/1
2,971,805 A 2/1961 Weiss
3,067,882 A 12/1962 Ribbens et al.
3,107,442 A * 10/1963 Levine ..... A47B 83/008 434/417
3,226,172 A * 12/1965 Bateman ..... A47F 3/00 312/140.1
3,407,941 A * 10/1968 Schmidt ..... B65F 1/1426 211/84
3,468,039 A * 9/1969 Dubbert ..... A47B 97/04 434/429
3,677,203 A * 7/1972 Barrineau ..... A47F 5/0037 108/166
3,770,333 A * 11/1973 Cusker ..... A47B 57/58 312/183
3,908,830 A * 9/1975 Skrzelowski ..... A47B 43/00 211/55
3,977,529 A 8/1976 Stroh
4,134,628 A 1/1979 Mann
4,276,984 A * 7/1981 Simmons ..... A47B 73/00 211/81
4,357,881 A * 11/1982 De Long ..... A47B 23/02 108/135
4,595,106 A * 6/1986 Kunze ..... B65G 9/002 211/118
4,733,782 A 3/1988 Spezial et al.
4,862,812 A * 9/1989 Godfrey ..... A47B 5/006 108/47
4,934,645 A 6/1990 Breslow
4,978,013 A * 12/1990 Hogg ..... A47F 5/13 211/132.1
5,253,770 A 10/1993 Rosenthal
5,427,255 A 6/1995 Nook
5,505,318 A * 4/1996 Goff ..... A47B 46/00 211/132.1
5,573,124 A 11/1996 Frost
5,590,796 A * 1/1997 Herman ..... A47F 5/108 108/99
5,738,019 A 4/1998 Parker
5,749,480 A * 5/1998 Wood ..... A47B 57/04 211/150
5,816,419 A * 10/1998 Lamson ..... A47B 57/045 211/150
5,918,750 A 7/1999 Jackson
5,921,190 A * 7/1999 Wood ..... A47F 5/103 108/106
6,220,461 B1 * 4/2001 Dickinson ..... A47B 57/045 108/108
6,241,107 B1 * 6/2001 Boyer ..... A47F 5/137 211/106
6,305,741 B1 * 10/2001 Fernandez ..... A47C 9/06 108/48
6,659,294 B1 12/2003 Simard
6,659,295 B1 * 12/2003 De Land ..... A47B 96/04 211/184
6,726,036 B2 * 4/2004 Koellner ..... D06F 57/12 211/104
6,811,233 B1 * 11/2004 Packer ..... B25H 1/04 108/176
7,175,034 B2 2/2007 Nook et al.
7,249,680 B2 * 7/2007 Wang ..... A47B 57/04 211/150
7,261,214 B2 8/2007 Wagner et al.
7,424,958 B1 * 9/2008 Eley ..... B25H 3/04 211/70.6
7,500,574 B1 3/2009 Miller, III et al.
7,516,853 B1 * 4/2009 Murillo, Jr. ..... A47F 5/0018 211/188
7,954,655 B2 * 6/2011 Virvo ..... A47F 5/0043 211/149
7,954,656 B1 6/2011 Cuzzocrea
8,210,368 B2 7/2012 Schwartzkopf et al.
8,281,943 B2 * 10/2012 Suman ..... A47F 5/0087 211/150
8,579,127 B2 * 11/2013 Dyck ..... A47B 96/068 211/103
8,665,583 B2 * 3/2014 Kinsley ..... A47B 46/005 211/150
8,668,175 B2 * 3/2014 Koleszar ..... H05K 7/1488 108/106
8,783,474 B2 * 7/2014 Kuhlman ..... B60N 3/02 211/113
9,357,840 B2 6/2016 Davis
9,415,874 B2 * 8/2016 Curtis ..... B60N 3/004
9,615,678 B1 * 4/2017 Lindblom ..... A47F 5/0087
9,782,996 B1 * 10/2017 Kuo ..... B42F 7/12
9,936,825 B1 * 4/2018 Lindblom ..... A47F 5/0087
2008/0142463 A1 * 6/2008 Johnson ..... A47B 57/20 211/187
2014/0111073 A1 4/2014 Kunis
2014/0263128 A1 9/2014 Garrett et al.
2015/0313357 A1 * 11/2015 David ..... A47B 47/0083 211/187

* cited by examiner

DISPLAY UNIT WITH SHELF

BACKGROUND

Businesses, such as retail stores, use a variety of display structures to present products and related information to customers for purchase. Hang bars or crossbars are components that are used with display structures to support hanging products that are being offered for sale. Shelves are display structures used for supporting products and may be attached to uprights on a gondola display unit.

The discussion above is merely provided for general background information and is not intended to be used as an aid in determining the scope of the claimed subject matter.

SUMMARY

A display unit includes at least one shelf having a first side, an opposing second side, a pair of brackets and at least one hang bar that is mounted to and protrudes from the first side or the second side. The at least one shelf is configured in a first orientation or a second orientation. In the first orientation, the pair of brackets are configured to orient the first side to face in an upward direction and the opposing second side to face in a downward direction. In the second orientation, the pair of brackets are configured to orient the first side to face in a forward direction and the opposing second side to face in a backward direction.

A display unit includes at least one shelf including a first side, an opposing second side, a pair of brackets and at least one hang bar that is mounted to and protrudes from the first side or the second side. A tower assembly including a back frame having a pair of vertical components with a plurality of front facing slots and a pair of right and left side angled frames coupled to the back frame. The at least one shelf is mounted inside the tower assembly by mating the pair of brackets with front facing slots in the pair of vertical components. The at least one shelf is configured into one of a first orientation and a second orientation. In the first orientation, the first side faces in an upward direction and the second side faces in a downward direction. In the second orientation, the first side faces in a forward direction and the second side faces in a backward direction.

A method of displaying merchandise includes mounting at least one shelf inside a tower assembly. The at least one shelf includes a first side, an opposing second side, a pair of brackets, and at least one hang bar that is mounted to and protrudes from the first side or the second side. The tower assembly includes a back frame having a pair of vertical components with a plurality of front facing slots that receive the pair of brackets of the at least one shelf and a pair of right and left side angled frames coupled to the back frame. The method further includes configuring the at least one shelf into a first orientation or a second orientation. In the first orientation, the first side faces in an upward direction and the opposing second side faces in a downward direction. In the second orientation, the first side faces in a forward direction and the second side faces in a backward direction.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a display unit with at least one shelf so that the shelf may be configured to display merchandise in different ways including the shelf being oriented in a first orientation and being oriented in a second orientation. The display unit also includes a tower assembly. The at least one shelf is mounted inside the tower assembly. More than one shelf may be mounted inside the tower assembly and spaced vertically apart from each other and one or more display units may be mounted to a gondola display fixture.

Figure 1:
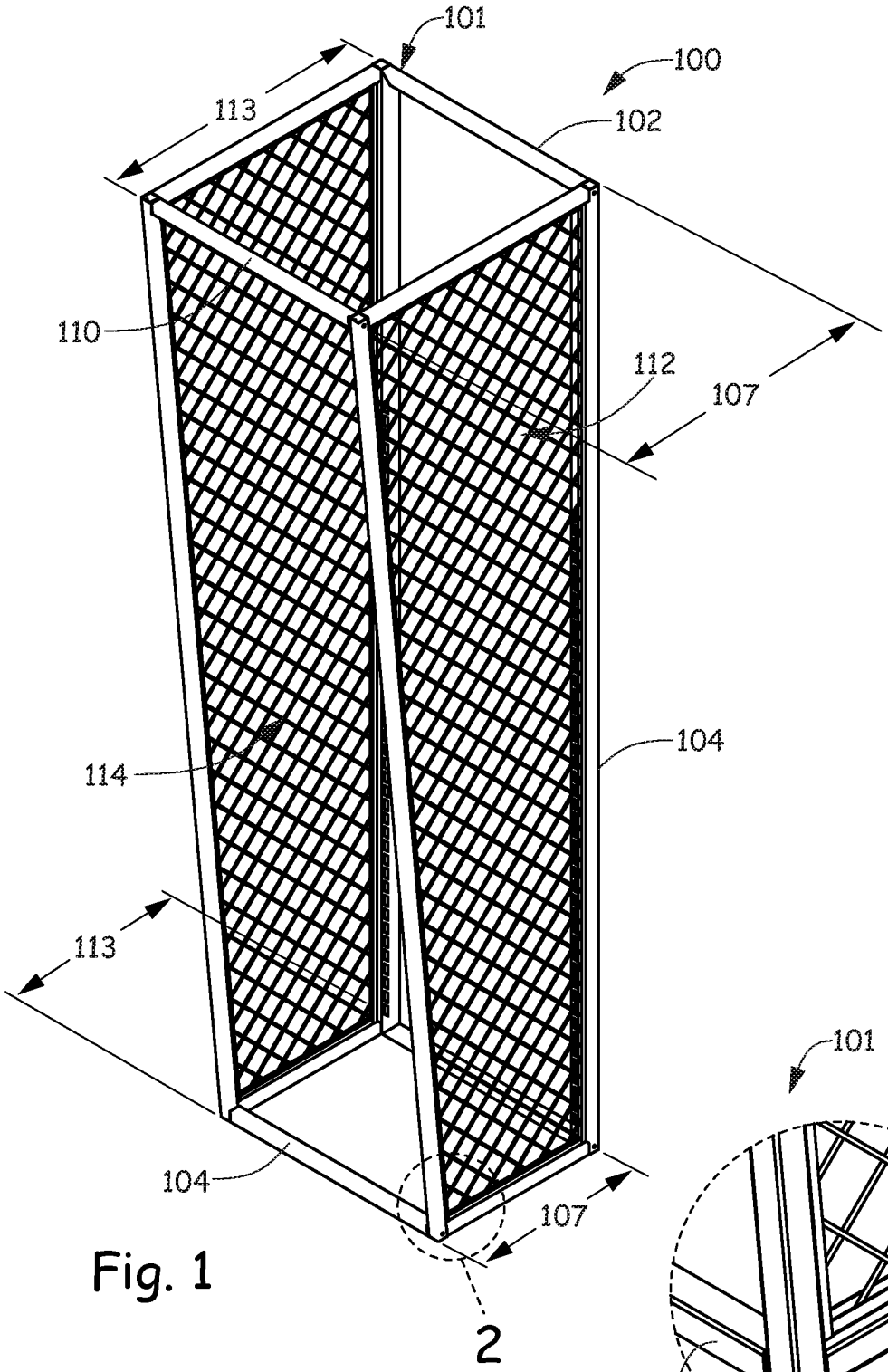
FIG. 1 is a perspective view of a display unit including a tower assembly according to an embodiment.

FIG. 1 is a perspective view of a display unit 100 according to an embodiment. Display unit 100 includes a tower assembly 101 having a back frame 102, a right side angled frame 104, a left side angled frame 106, a base tie plate 108, a top tie plate 110 and a pair of metal mesh weldments 112 and 114. Right and left side angled frames 104 and 106 have a depth dimension 107 and 109 at their tops and a depth dimension 111 and 113 at their bottoms. Dimensions 107 and 109 are greater than dimensions 111 and 113, respectively. Metal mesh weldment 112 is located inside right side angled frame 104 and metal mesh weldment 114 is located inside left side angled frame 106. In one embodiment, metal mesh weldments 112 and 114 are welded to the insides of frames 104 and 106, respectively.

Figure 2:
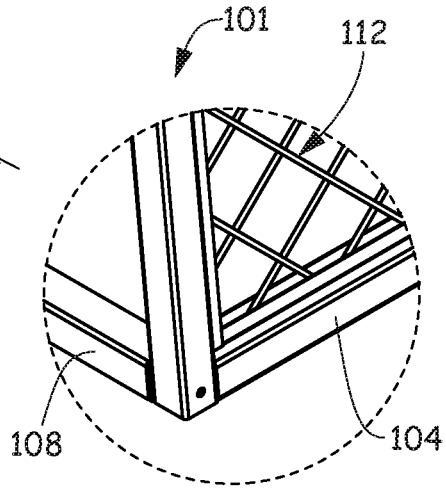
FIG. 2 is an enlarged view of a portion of the tower assembly illustrated in FIG. 1.

FIG. 2 is an enlarged view of a portion of tower assembly 101. As illustrated and in one embodiment, base tie plate 108 is fastened to a front bottom corner of right side angled frame 104. Likewise, the opposing end of base tie plate 108 is fastened to a front bottom corner of left side angled frame 106. Opposing ends of top tie plate 110 are fastened to front top corners of right side angled frame 104 and left side angled frame 106. Further and in one embodiment, back frame 102 is fastened to back top corners of right side angled frame 104 and left side angled frame 106 and back bottom corners of right side angled frame 104 and left side angled frame 106.

Figure 3:
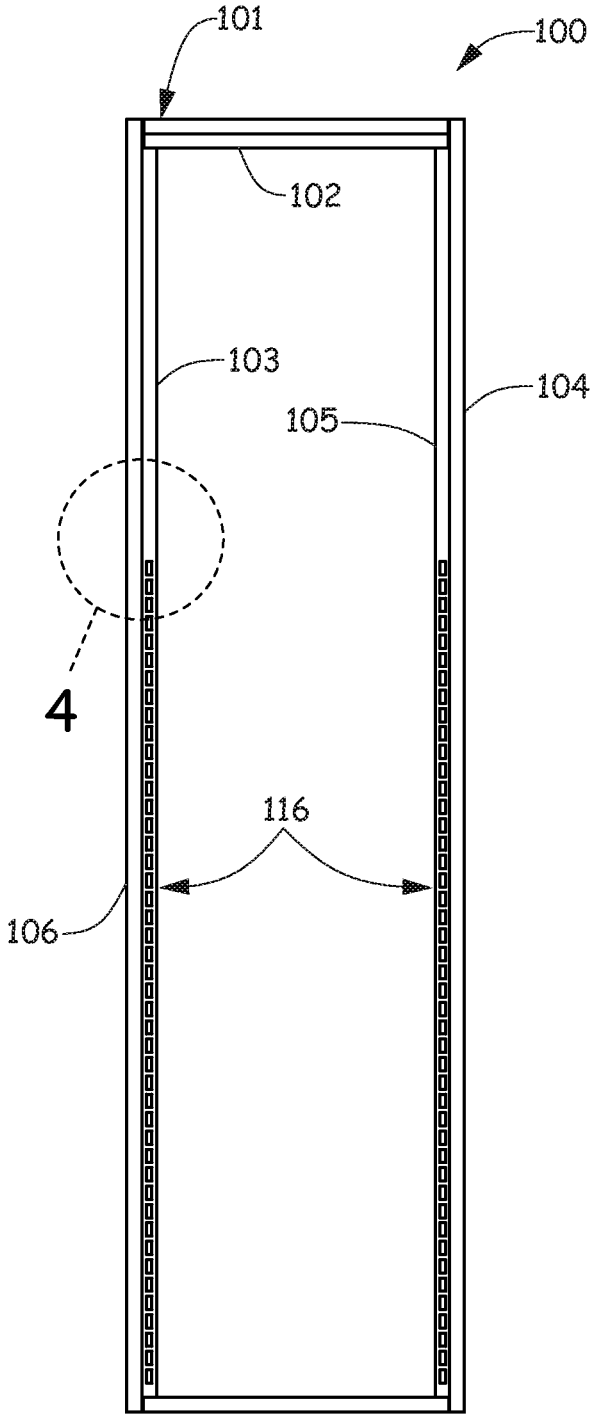
FIG. 3 is a front view of the tower assembly illustrated in FIG. 1.
Figure 4:
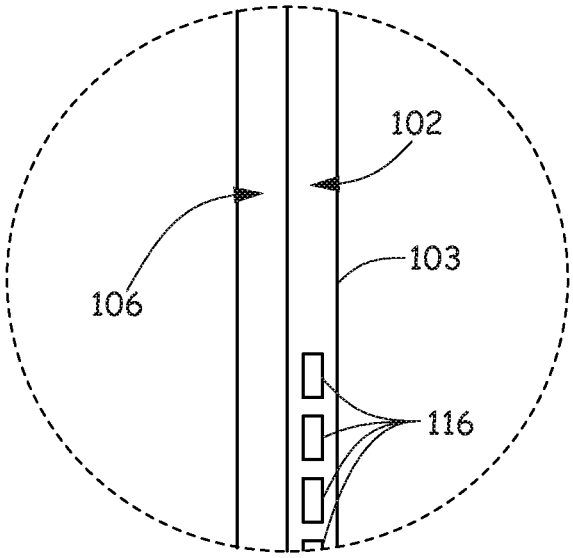
FIG. 4 is an enlarged view of a portion of the tower assembly illustrated in FIG. 1.

FIG. 3 is a front view of tower assembly 101. In one embodiment, back frame 102 includes a plurality of slots located on portions of the front faces of the vertical components 103 and 105 of back frame 102. FIG. 4 is an enlarged view of a portion of tower assembly 101 including select slots of the plurality of slots 116. Slots 116 are configured to receive brackets for the mounting of display components. While slots 116 are illustrated as extending from a bottom of the front faces of vertical components 103 and 105 to an area of back frame 102 that is greater than half way up the back frame, but less than three-fourths the way up the back frame, it should be recognized that slots 116 can be located on any portion of the front faces of vertical components 103 and 105 for receiving display components.

Figure 5:
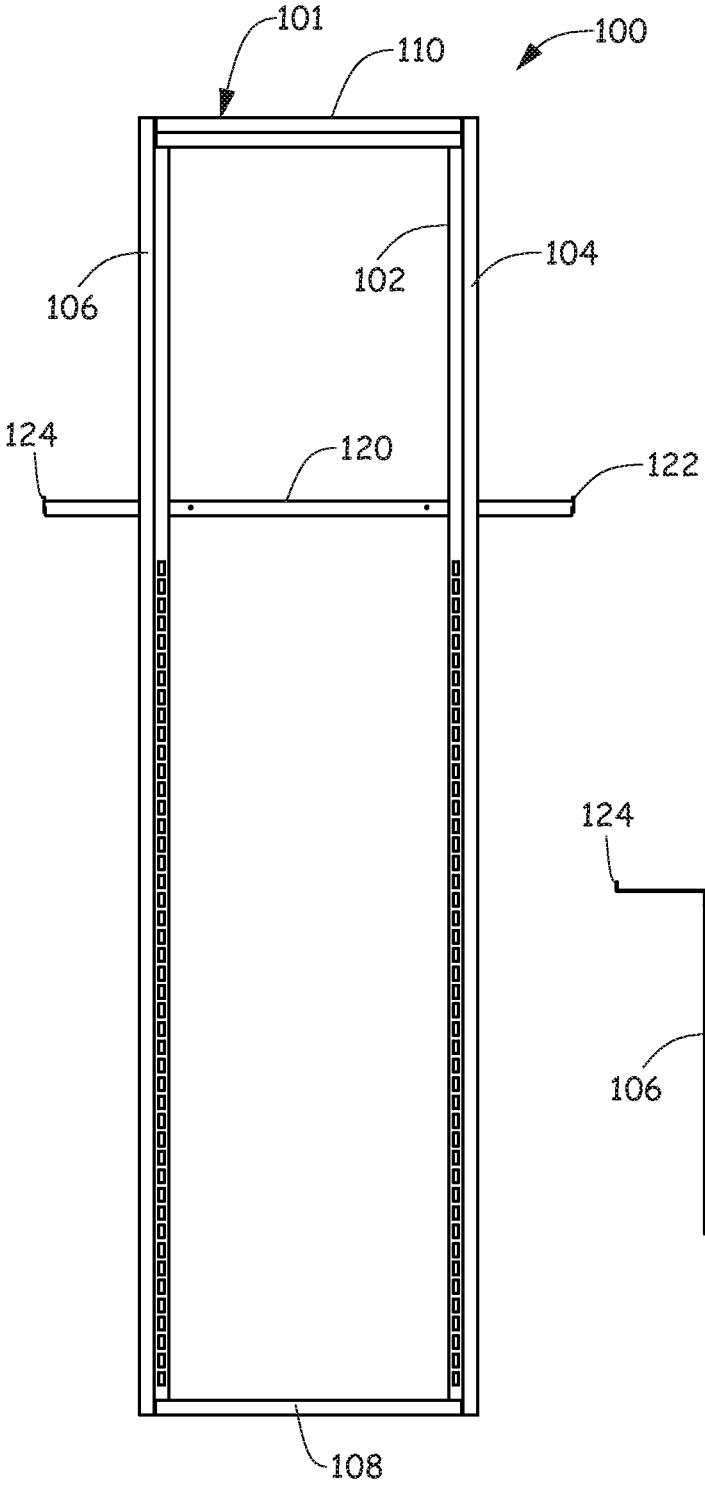
FIG. 5 is a front view of the tower assembly illustrated in FIG. 1 with a crossbar for mounting to a gondola display fixture.
Figure 6:
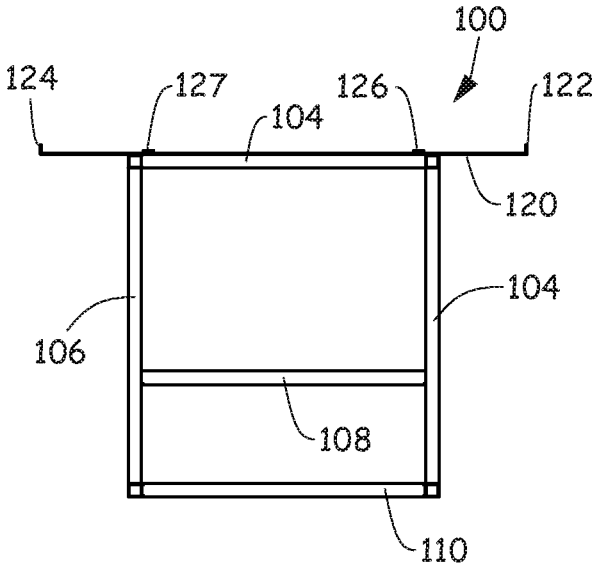
FIG. 6 is a top view of FIG. 5.
Figure 7:
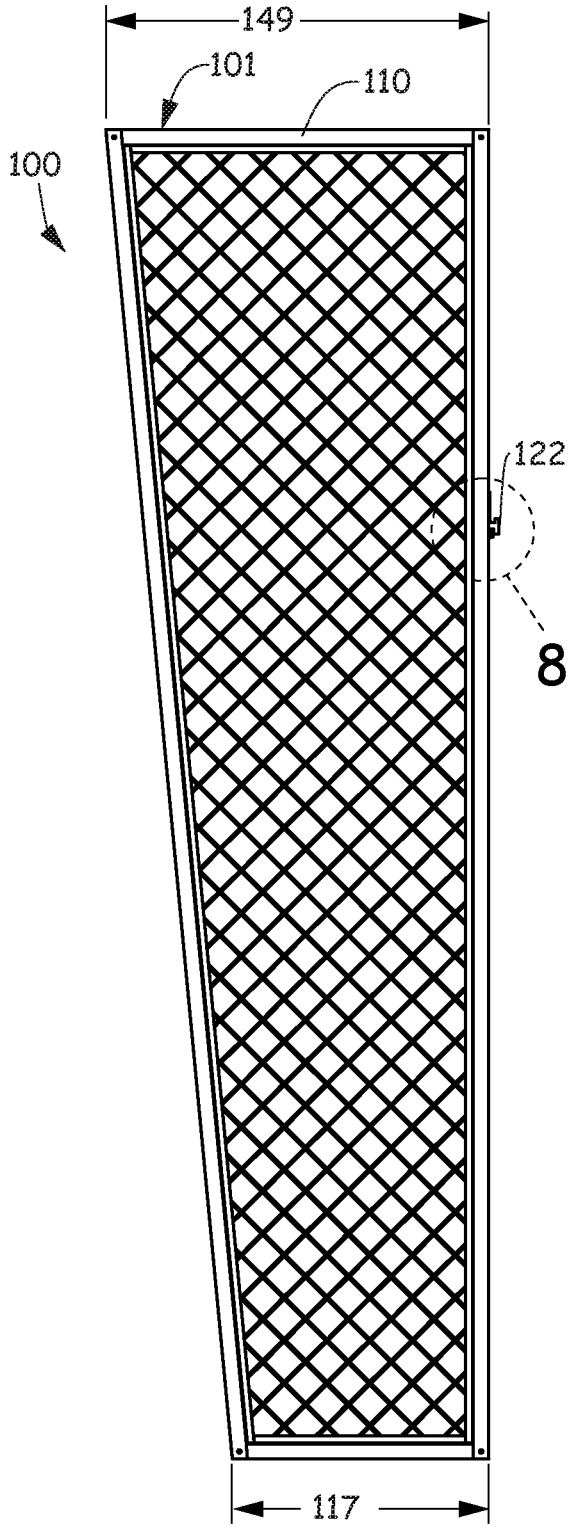
FIG. 7 is a right side view of FIG. 5.
Figure 8:
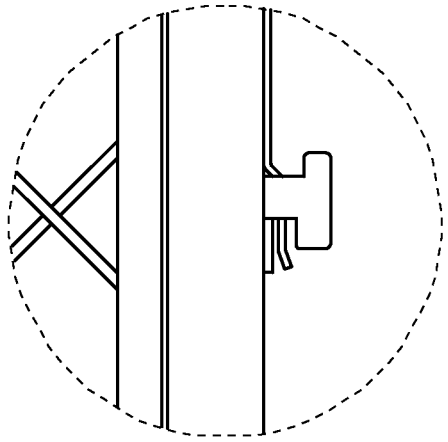
FIG. 8 is an enlarged view of a portion of FIG. 5 showing a bracket of the tower assembly engaged with the crossbar.
Figure 9:
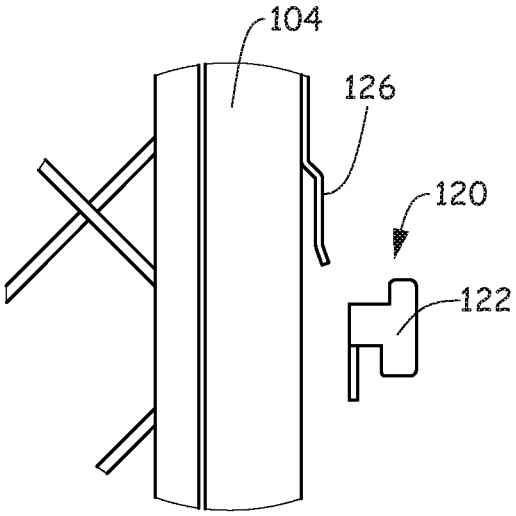
FIG. 9 is an enlarged view showing the bracket of the tower assembly disengaged with the crossbar.

FIG. 5 is a front view, FIG. 6 is a top view and FIG. 7 is a right side view of display unit 100 with a crossbar 120 for mounting tower assembly 101 to a gondola display fixture. FIG. 8 is an enlarged view of a portion of FIG. 5 showing a support 126 of tower assembly 101 engaged with crossbar 120, and FIG. 9 is an enlarged view showing support 126 of tower assembly 101 disengaged from crossbar 120. As previously described and under one embodiment, one or more display units 100 may be mounted to a gondola display fixture and, under another embodiment, display units 100 may be horizontally spaced apart from each other along the gondola display fixture. Each display unit 100 is mounted to a gondola display fixture with a cross bar 120. The opposing ends of each cross bar 120 include brackets 122 and 124 that are mounted into slots in standard uprights of the gondola display fixture. The back faces of each vertical component 103 and 105 of back frame 102 (that oppose the front faces of each vertical component 103 and 105 that include slots 116) includes supports 126 and 127. As illustrated in FIGS. 8 and 9 and in one embodiment, supports 126 and 127 are slid over the main body of cross bar 120 to securely mount display unit 100 and therefore tower assembly 101 to a gondola display fixture.

Figure 10:
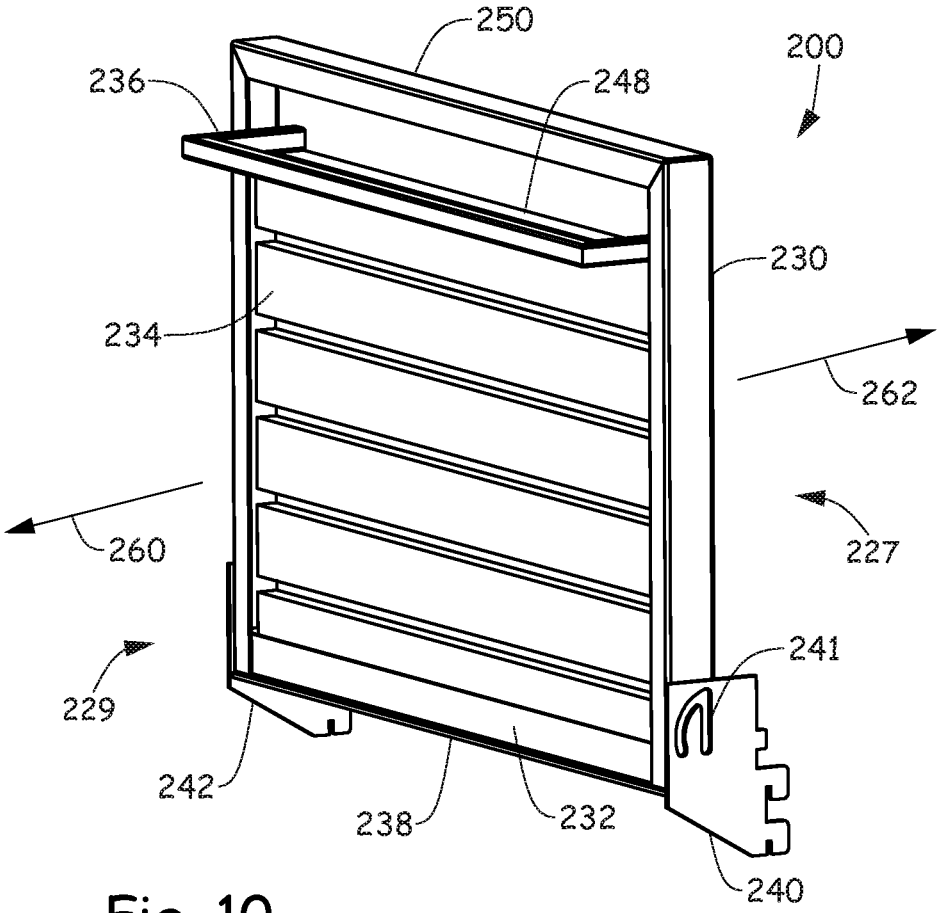
FIG. 10 is a perspective view of a shelf configured for use with the tower assembly illustrated in FIGS. 1-9 in a second orientation according to an embodiment.
Figure 11:
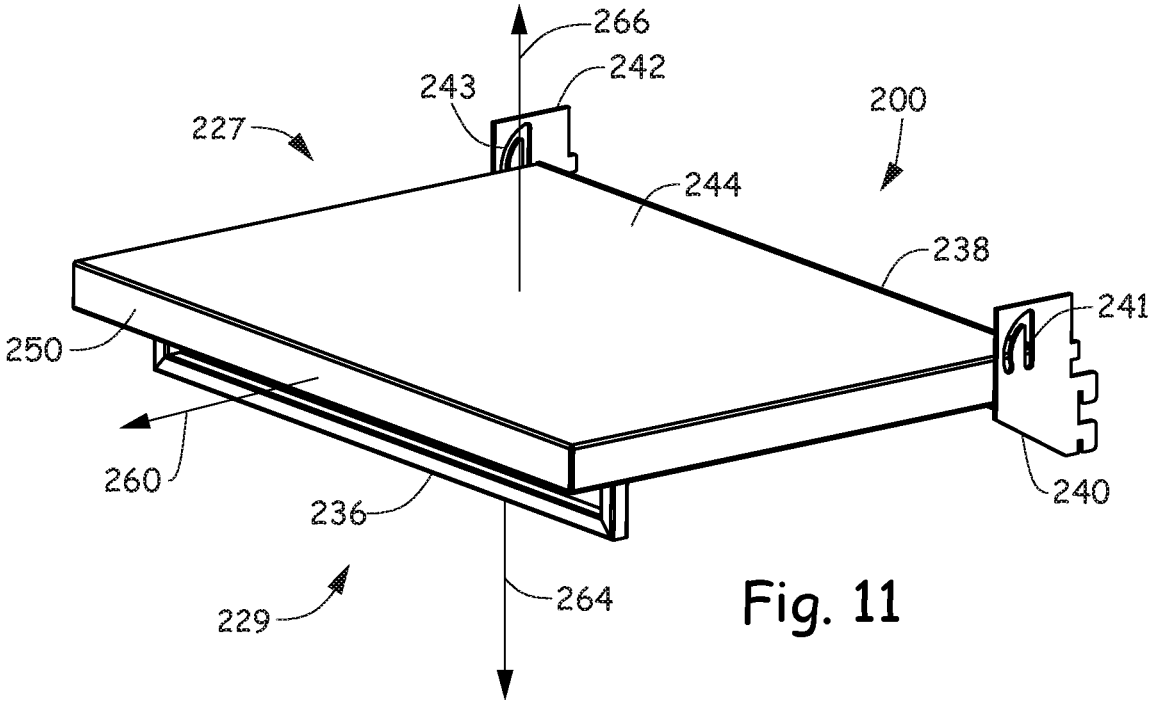
FIG. 11 is a perspective of the shelf of FIG. 10 in a first orientation according to an embodiment.
Figure 12:
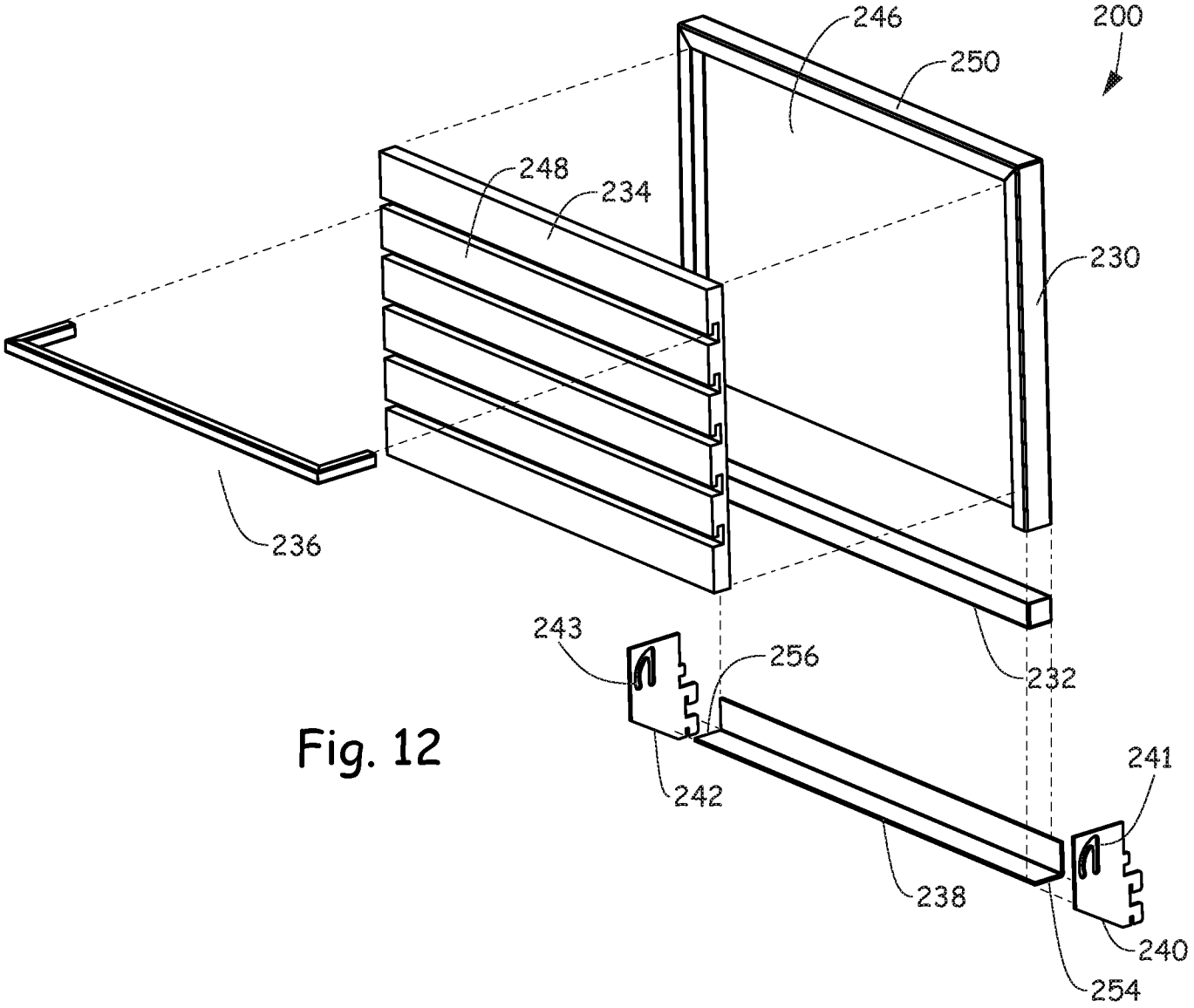
FIG. 12 is an exploded view of the shelf in FIGS. 10 and 11.
Figure 13:
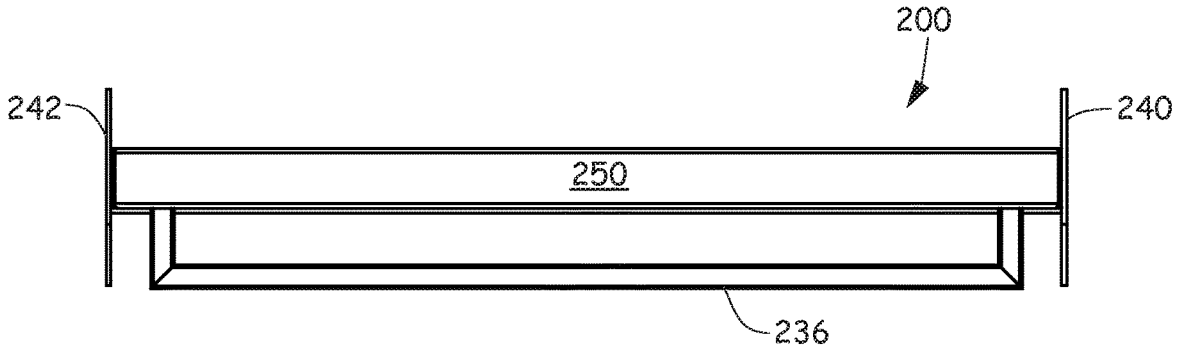
FIG. 13 is a front view of FIG. 11.

FIG. 10 is a perspective view of a shelf 200 according to an embodiment. In this embodiment, shelf 200 is a rotatable shelf and in FIG. 10 is oriented in a second orientation. FIG. 11 is a perspective of rotatable shelf 200 in a first orientation. FIG. 12 is an exploded view of rotatable shelf 200. Rotatable shelf 200 includes a first side 227, an opposing second side 229, a base 230, a backing 232, a slat wall 234, a hang bar 236, a bracket support 238 and a pair of brackets 240 and 242. FIG. 13 is a front view of rotatable shelf 200 in the first orientation, FIG. 14 is a right side view of rotatable shelf 200 in the first orientation and FIG. 15 is a front view of rotatable shelf 200 in the second orientation.

Base 230 includes a first surface 244 and an opposing second surface 246. As illustrated in FIG. 12, slat wall 234 and hang bar 236 are mounted to second surface 246 of base 230 and therefore second side 229 of rotatable shelf 200. In particular, slat wall 234 is directly mounted to second surface 246 and hang bar 236 is mounted to second surface 246 through slat wall 234. Hang bar 236 therefore protrudes from second surface 246 of base 230. In the illustrated embodiment, hang bar 236 is mounted so that it aligns and couples with a top of a first slat 248 in slat wall 234. First slat 248 is located closer to a free end 250 of base 230 compared to other slats in slat wall 234. However, in other embodiments, hang bar 236 may be mounted so that it aligns and couples with a different slat than first slat 248 in slat wall 234. Fixed end 252 of base 230 is coupled to backing 232 and backing 232 is coupled to bracket support 238. First bracket 240 is attached to a first end 254 of bracket support 238 and second bracket 242 is attached to a second end 256 of bracket support 238.

Figure 15:
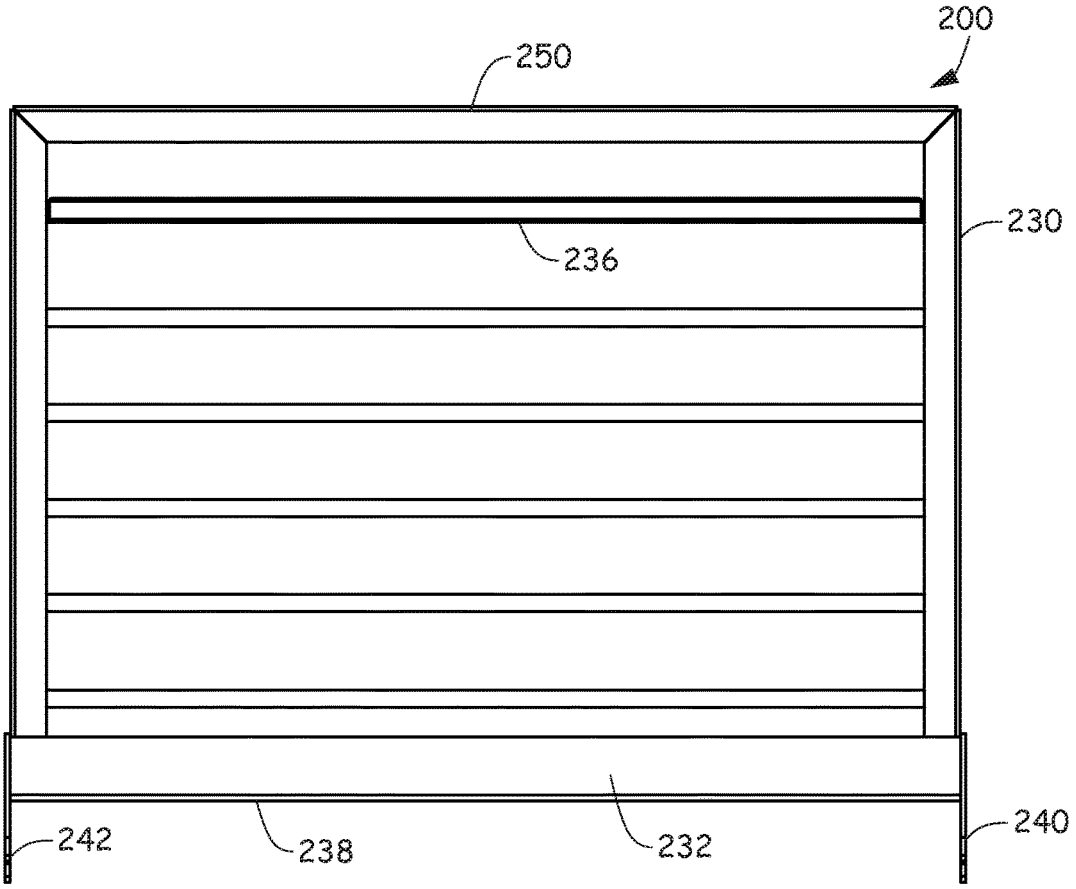
FIG. 15 is a front view of FIG. 10.

As illustrated in FIGS. 10 and 15, rotatable shelf 200 may be configured in the second orientation. In other words, second side 229, second surface 246, slat wall 234 and the slats on slat wall 234 as well as hang bar 236 are oriented to face in a forward direction 260, while first side 227 and first surface 244 of base 230 face in a backward direction 262. In one embodiment, first side 227 and first surface 244 face a back wall of a gondola display fixture where rotatable shelf 200 is directly coupled to uprights of the gondola display unit with brackets 240 and 242. In another embodiment, first side 227 and first surface 244 face a back wall of a gondola display fixture where rotatable shelf 200 is directly coupled to slots in vertical components 103 and 105 in back frame 102 of tower assembly 101 and display unit 100 is directly coupled to uprights of the gondola display fixture. In the second orientation, hang bar 236 protrudes outwardly toward customers or guests. In one embodiment, merchandise, such as hanging merchandise, may be directly hung on hang bar 236 for display. In another embodiment, saddle mount peg hooks, face out bars, waterfalls and hooks may be coupled to hang bar 236 to present hanging merchandise in alternative ways.

Figure 14:
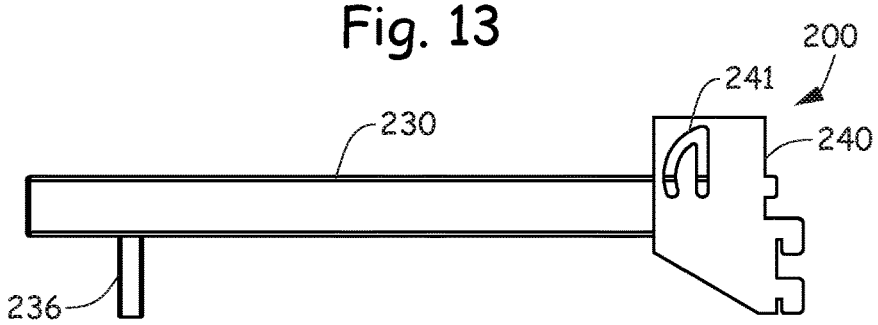
FIG. 14 is a right side view of FIG. 11.

As illustrated in FIGS. 11, 13 and 14, rotatable shelf 200 may be configured in the first orientation. In other words, second side 229, second surface 246, slat wall 234 and the slats on slat wall 234 as well as hanger 236 are oriented to face in a downward direction 264, while first side 227, first surface 244 of base 230 is oriented to face in an upward direction 266. In this configuration, free end 250 faces in forward direction 260. In the first orientation, hang bar 236 protrudes in a downward direction 264 to face a base deck of the gondola display fixture. In this embodiment, merchandise, such as hanging merchandise, may be directly hung on hang bar 236 for display. In addition, merchandise may rest on first surface 244 for display. In this first orientation, the display may become viable for cross-merchandising, which is the retail practice of marketing or displaying products from different categories together on the same display.

The pair of brackets 240 and 242 are configured to orient rotatable shelf 200 in one of the first orientation and the second orientation. Each of first bracket 240 and second bracket 242 of rotatable shelf 200 includes a slot 241 and a slot 243, respectively. Slots 241 and 243 are coupled to base 230 using hardware. The hardware guides and holds rotatable shelf 200 in the first orientation illustrated in FIG. 11 by holding the hardware in a first position within slots 241 and 243. The hardware also guides and holds rotatable shelf 200 in the second orientation illustrated in FIG. 10 by holding the hardware in a second position within slots 241 and 243.

Figure 16:
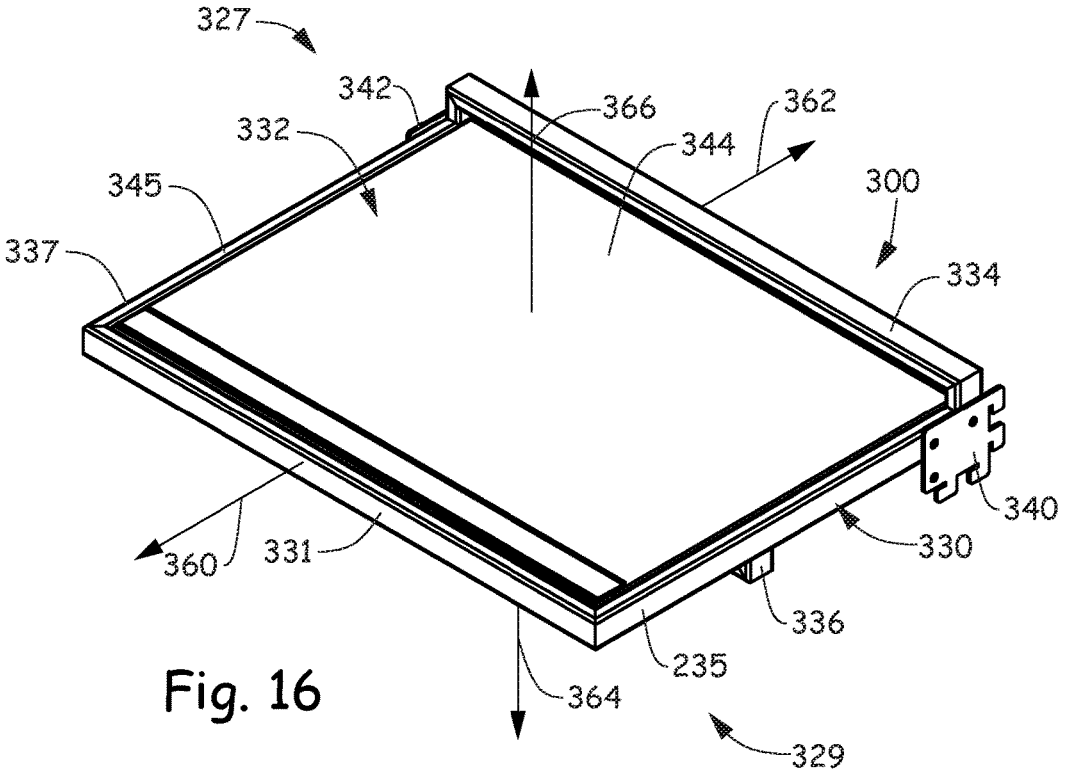
FIG. 16 is a perspective of a shelf configured for use with the tower assembly illustrated in FIGS. 1-9 in a first orientation according to an embodiment.
Figure 17:
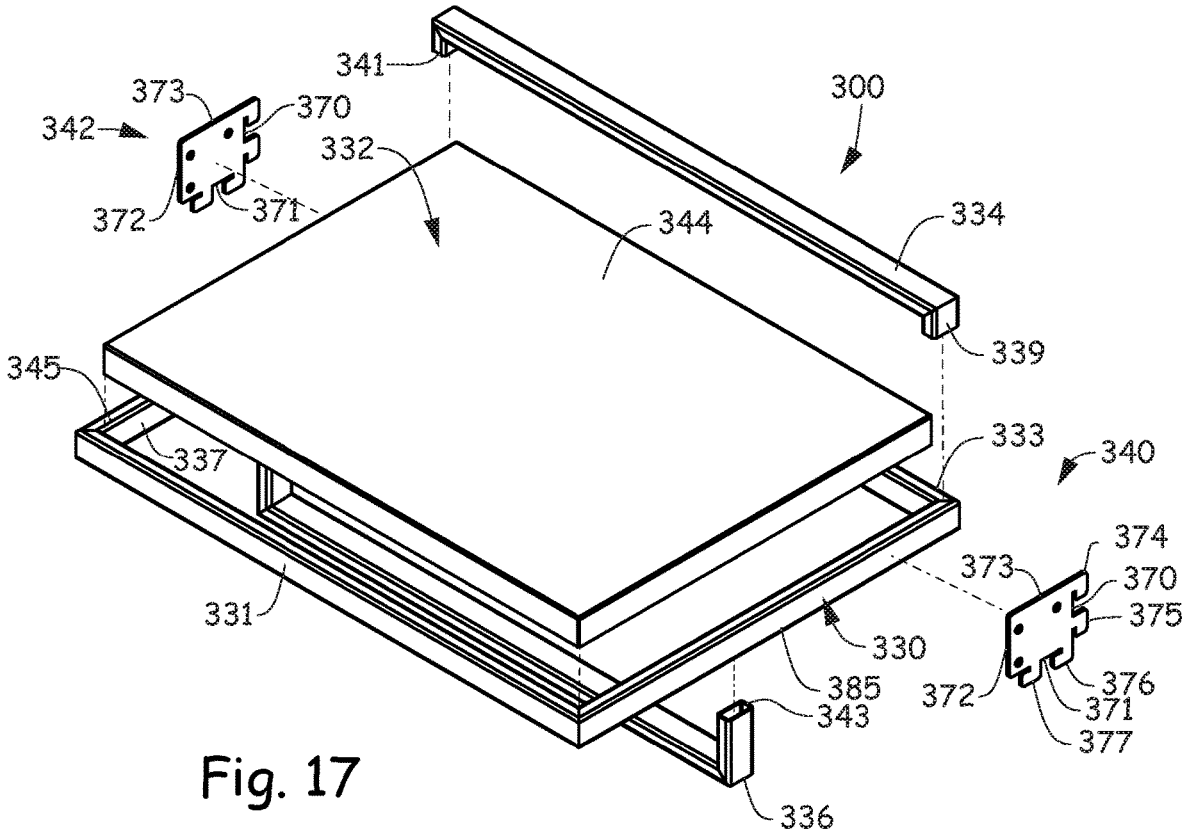
FIG. 17 is an exploded perspective view of the shelf in FIG. 16.
Figure 18:
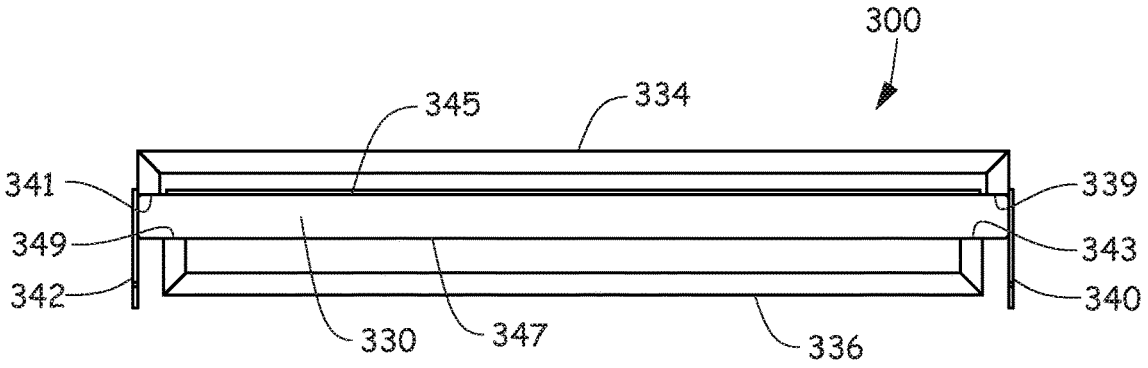
FIG. 18 is a front view of FIG. 16.
Figure 19:
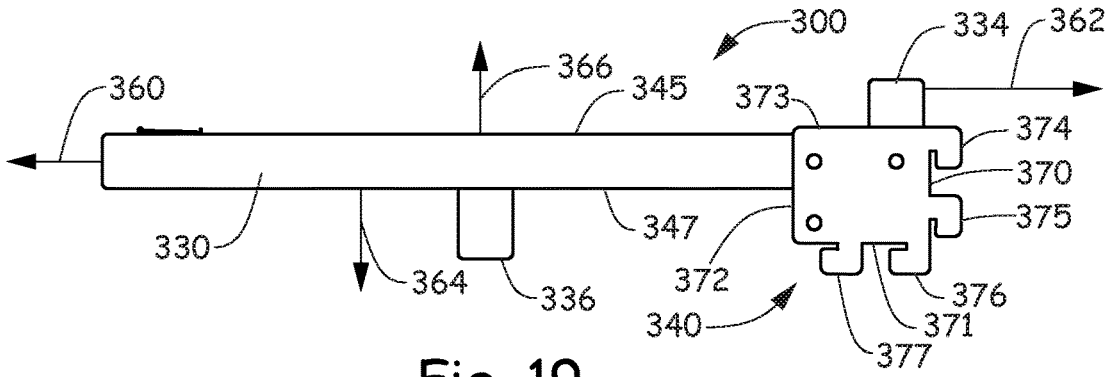
FIG. 19 is a right side view of FIG. 16.
Figure 20:
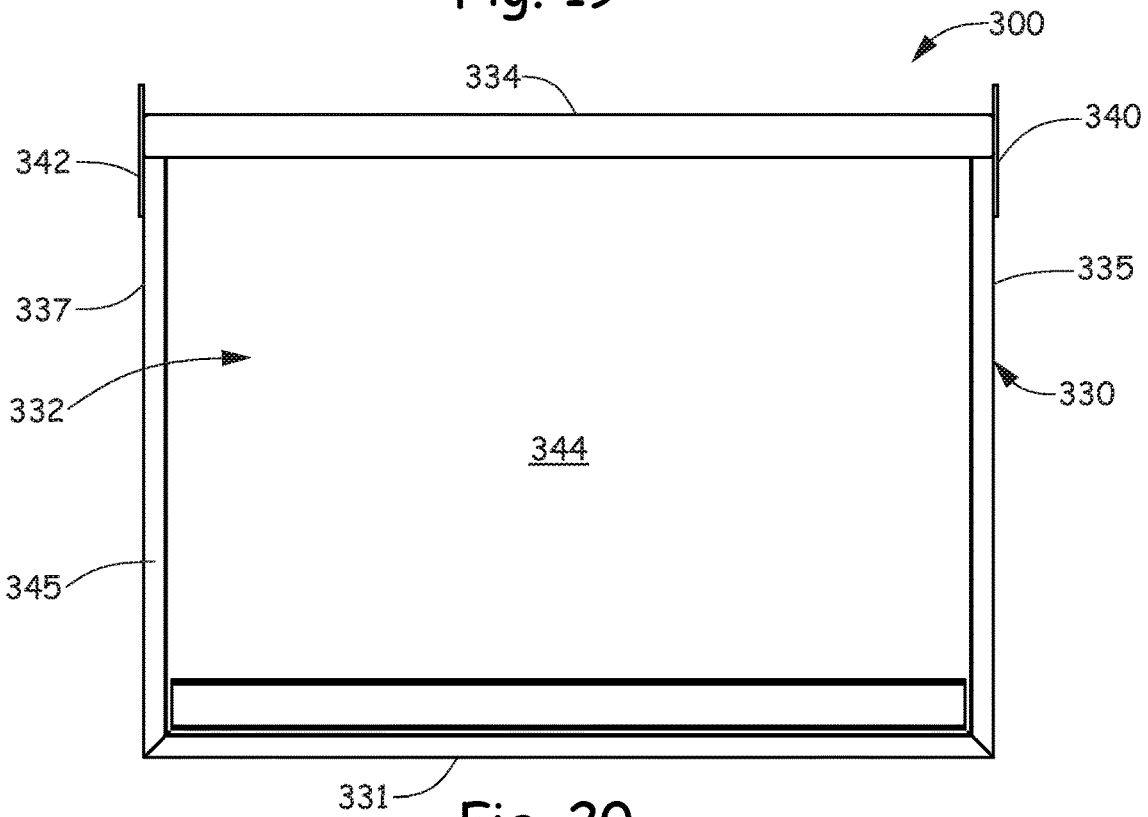
FIG. 20 is a top view of FIG. 16.
Figure 21:
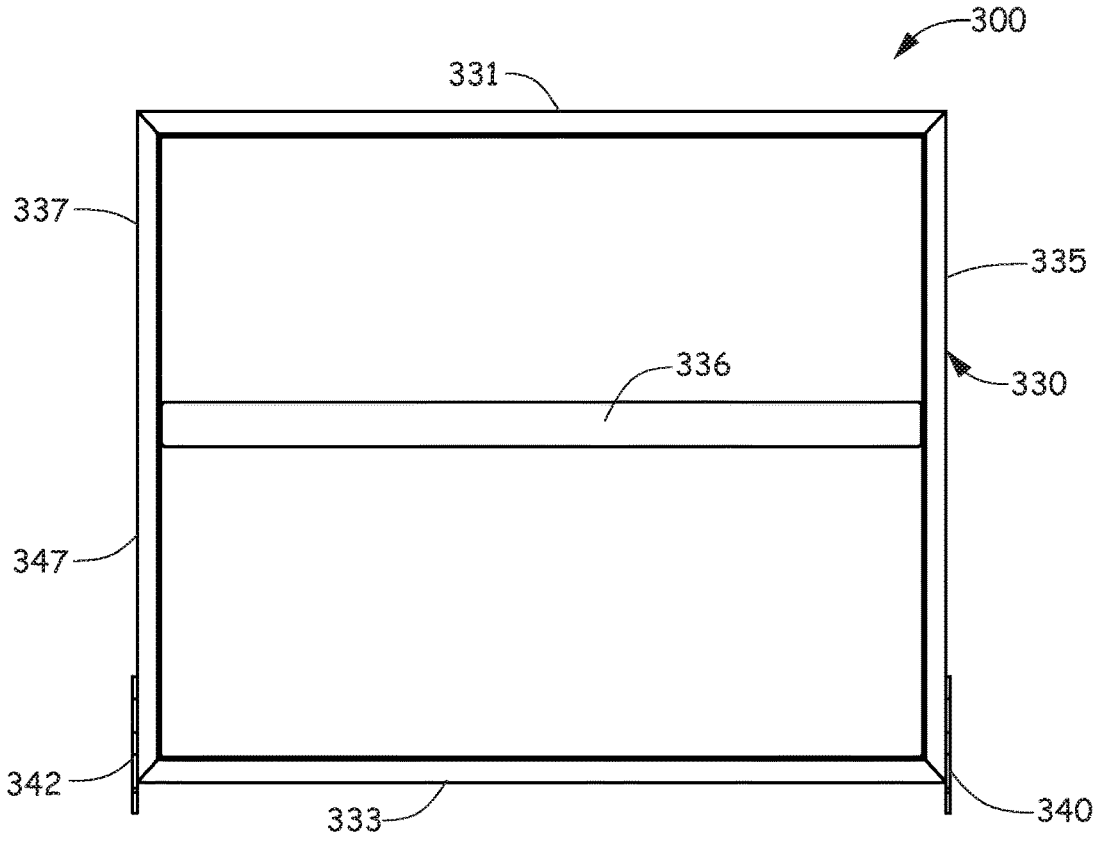
FIG. 21 is a bottom view of FIG. 16.

FIG. 16 is a perspective view of a shelf 300 configured for use with tower assembly 101 illustrated in FIGS. 1-9 in a first orientation according to another embodiment. FIG. 17 is an exploded perspective view of shelf 300, FIG. 18 is a front view of shelf 300 in the first orientation, FIG. 19 is a right side view of shelf 300 in the first orientation, FIG. 20 is a top view of shelf 300 in the first orientation and FIG. 21 is a bottom view of shelf 300 in the first orientation.

Shelf 300 includes a first side 327, an opposing second side 329, a support frame 330, a base 332, a first hang bar 334, a second hang bar 336 and a pair of brackets 340 and 342. Support frame 330 includes a first widthwise member 331, an opposing second widthwise member 333, a first right side member 335 that joins the first and second widthwise members 331 and 333 on a right side and a second right side member 337 that joins the first and second widthwise members 331 and 333 on a left side. Base 332 includes a first surface 344 and an opposing second surface 346 and is located inside members 331, 333, 335 and 337 of support frame 330. In this way, each of members 331, 333, 335 and 337 of support frame 330 also includes a first surface 345 and each of members 331, 333, 335 and 337 of support frame 220 includes an opposing second surface 347. First surface 345 of support frame 330 is located adjacent to first surface 344 of base 332 and second surface 347 of support frame 330 is located adjacent to second surface 346 of base 332.

As illustrated in FIGS. 16 and 17, first hang bar 334 includes a first end 339 mounted to first surface 345 of support frame 330 at first right side member 335 in a location where second widthwise member 333 joins first right side member 335. First hang bar 334 includes a second end 341 mounted to first surface 345 of support frame 330 at second left side member 337 in a location where second widthwise member 333 joins second left side member 337. First hang bar 334 therefore protrudes from first side 327 of shelf 300 and first surface 345 of support frame 330. Second hang bar 336 includes a first end 343 mounted to second surface 346 of base 332 and a second end 349 (FIG. 18) also mounted to second surface 346 of base 332. First end 343 is mounted to second surface 346 of base 332 in a location that is spaced apart from the location that second end 349 is mounted to second surface 346. In particular, first end is mounted adjacent to first right side member 335 of support frame 330 and second end 349 is mounted adjacent to second left side member 337 of support frame 330. Second hang bar 336 therefore protrudes from second side 329 of shelf 300 and second surface 347 of support frame 330.

In the first orientation illustrated in FIGS. 16-21, second side 329 of shelf 300 is oriented to face in a downward direction 364, while first side 327 of shelf 300 is oriented to face in an upward direction 366. Also in this first orientation, first widthwise member 331 of support frame 330 is a front member and faces in forward direction 360 and second widthwise member 333 is a back member and faces in backward direction 362. Second hang bar 336 protrudes in downward direction 364 to face a base deck of the gondola display fixture. In this first orientation, merchandise, such as hanging merchandise, may be directly hung on second hang bar 336 for display. In addition, merchandise may rest on first surface 344 of base 330 for display. Therefore, the display may become viable for cross-merchandising, which is the retail practice of marketing or displaying products from different categories together on the same display.

Figure 22:
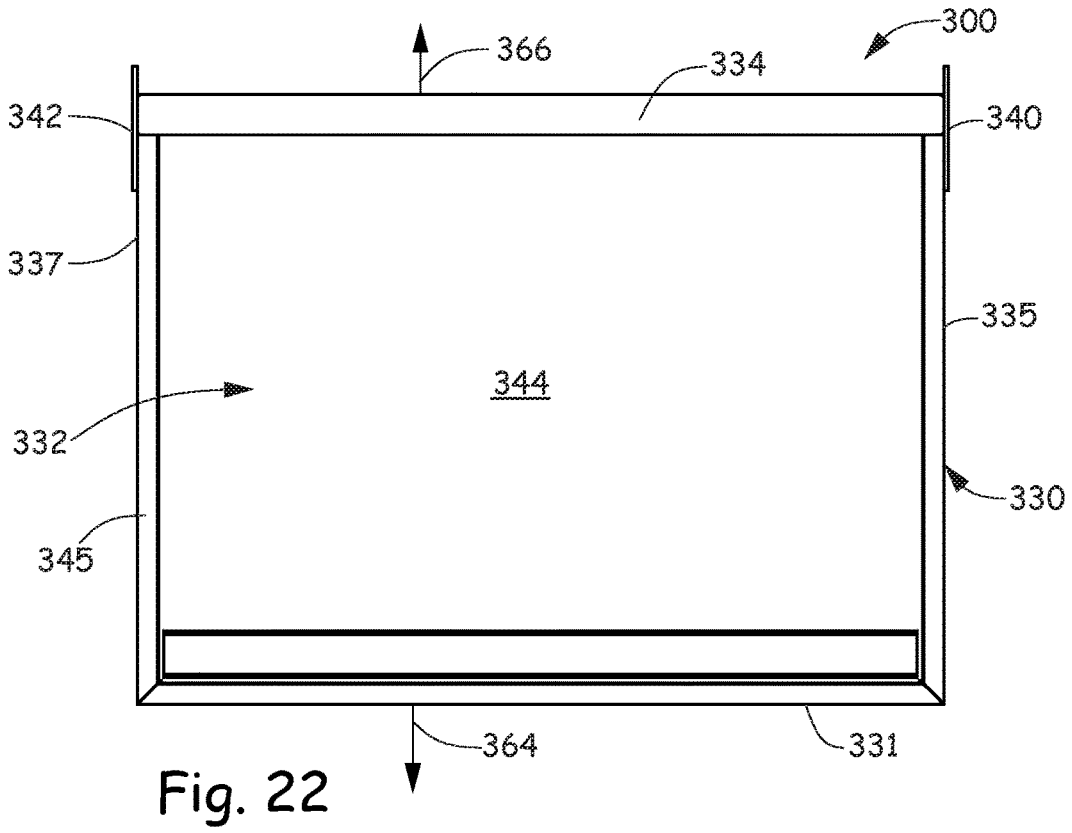
FIG. 22 is a front view of the shelf of FIG. 16 configured for use with the tower assembly illustrated in FIGS. 1-9 in a second orientation according to an embodiment.
Figure 23:
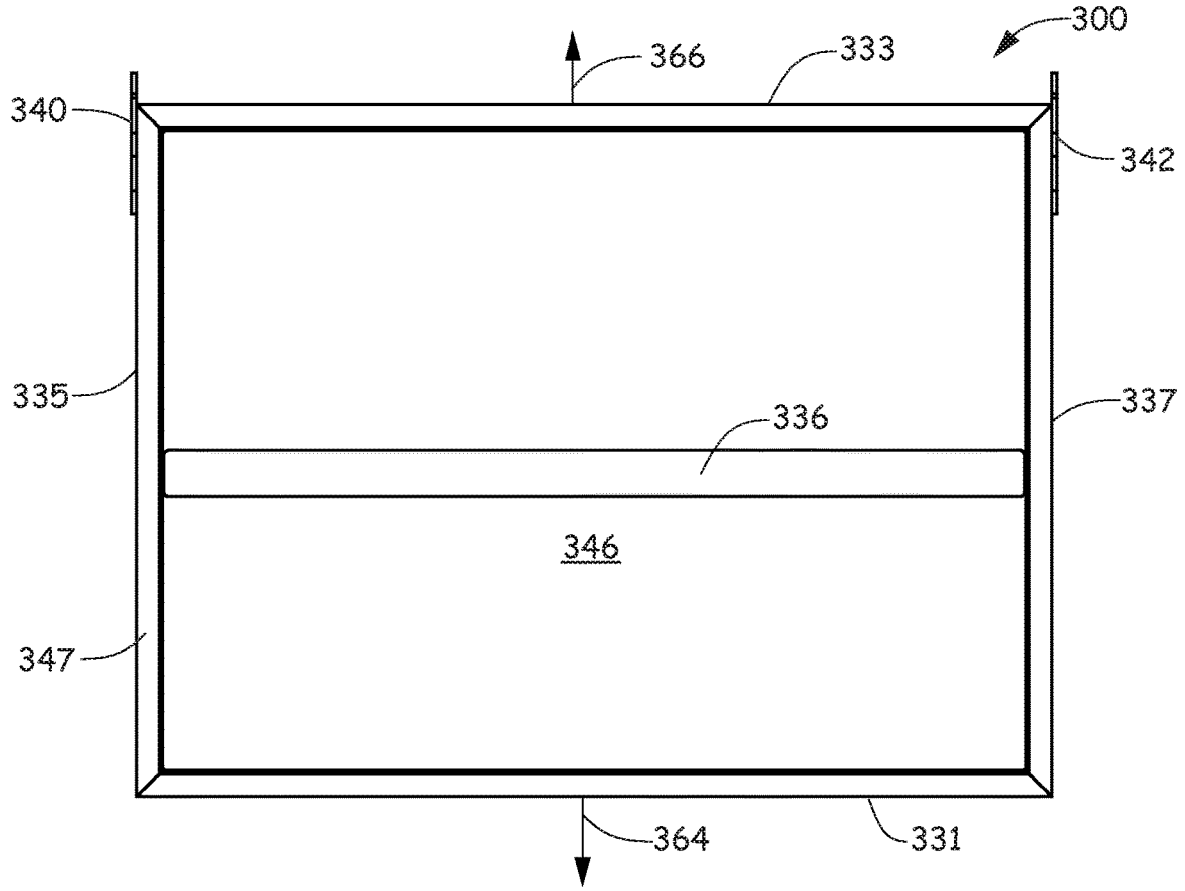
FIG. 23 is a back view of FIG. 22.
Figure 24:
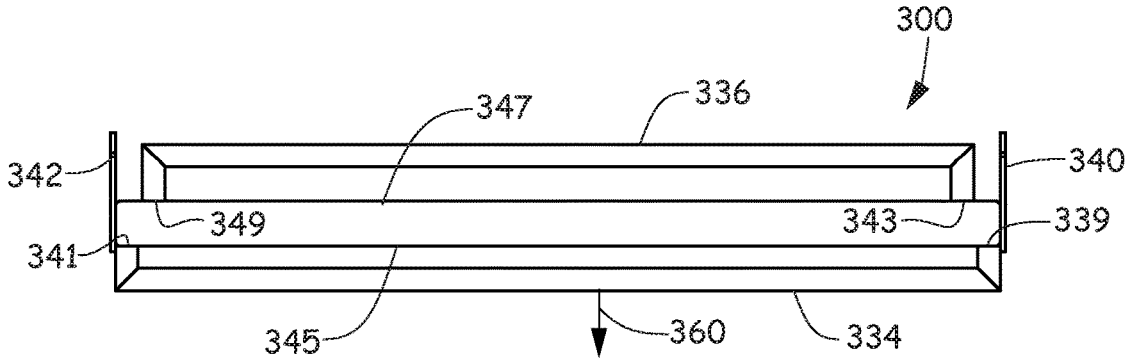
FIG. 24 is a top view of FIG. 22.
Figure 25:
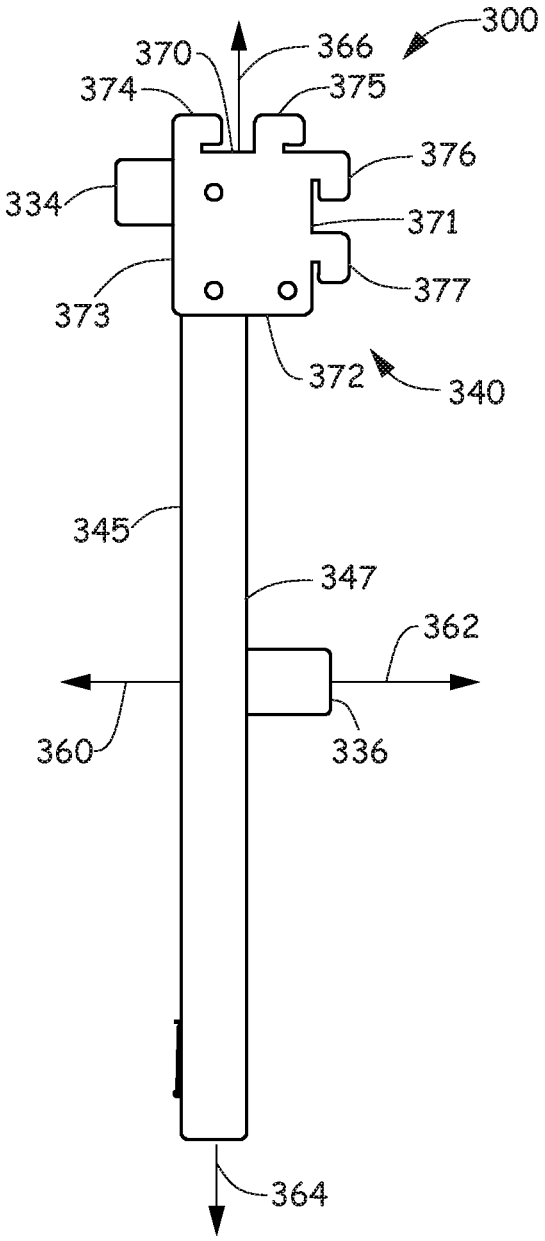
FIG. 25 is a right side view of FIG. 22.

FIG. 22 is a front view of shelf 300 configured for use with tower assembly 101 illustrated in FIGS. 1-9 in a second orientation according to an embodiment. FIG. 23 is a back view of shelf 300 in the second orientation, FIG. 24 is a top view of shelf 300 in the second orientation and FIG. 25 is a right side view of shelf 300 in the second orientation.

In the second orientation, first side 327 of shelf 300 and first surface 344 of base 332 are oriented to face in a forward direction 360, while second side 329 of shelf 300 and second surface 346 of base 332 are oriented to face in a backward direction 362. In one embodiment, second side 329 and second surface 346 face a back wall of a gondola display fixture where shelf 300 is directly coupled to uprights of the gondola display unit with brackets 340 and 342. In another embodiment, second side 329 and second surface 346 face a back wall of a gondola display fixture where shelf 300 is directly coupled to slots in vertical components 103 and 105 in back frame 102 of tower assembly 101 and display unit 100 is directly coupled to uprights of the gondola display fixture. In the second orientation, first hang bar 334 protrudes from first side 327 outwardly toward customers or guests in forward direction 360. In one embodiment, merchandise, such as hanging merchandise, may be directly hung on first hang bar 334 for display. In another embodiment, saddle mount peg hooks, face out bars, waterfalls and hooks may be coupled to first hang bar 334 to present hanging merchandise in alternative ways.

The pair of brackets 340 and 342 are configured to orient shelf 300 in one of the first orientation and the second orientation. Each of first bracket 340 and second bracket 342 of rotatable shelf 200 includes four sides: a first side 370, a second side 371, a third side 372 and a fourth side 373. First side 370 and third side 372 are parallel to each other and second side 371 and fourth side 373 are parallel to each other and perpendicular to first side 370 and third side 372. Each of first bracket 340 and second bracket 342 also include a set of first hooks and a set of second hooks. The set of first hooks includes hooks 374 and 375 and the set of second hooks includes hooks 376 and 377. Protruding from first side 370 are the set of first hooks 374 and 375 and protruding from second side 371 are the set of second hooks 376 and 377.

Bracket 340 is mounted to the outer side of first right side member 335 and bracket 342 is mounted to the outer side of second left side member 337. When shelf 300 is oriented in the first orientation, first sides 370 of brackets 340 and 342 are in alignment with the back of support frame 330, the first set of hooks 374 and 375 protrude in the backward direction 362 from support frame 330 and the second set of hooks 376 and 377 protrude in the downward direction 364 from support frame 330. In this way, the first set of hooks 374 and 375 are used to mount shelf 300 to tower assembly 101 so that shelf 300 is in the first orientation. When shelf 300 is oriented in the second orientation, first sides 370 of brackets 340 and 342 are in alignment with the top of support frame 330, the first set of hooks 374 and 375 protrude in the upward direction 366 and the second set of hooks 376 and 377 protrude in the backward direction 362. In this way, the second set of hooks 376 and 377 are used to mount shelf 300 to tower assembly 101 so that shelf 300 is in the second orientation.

Figure 26:
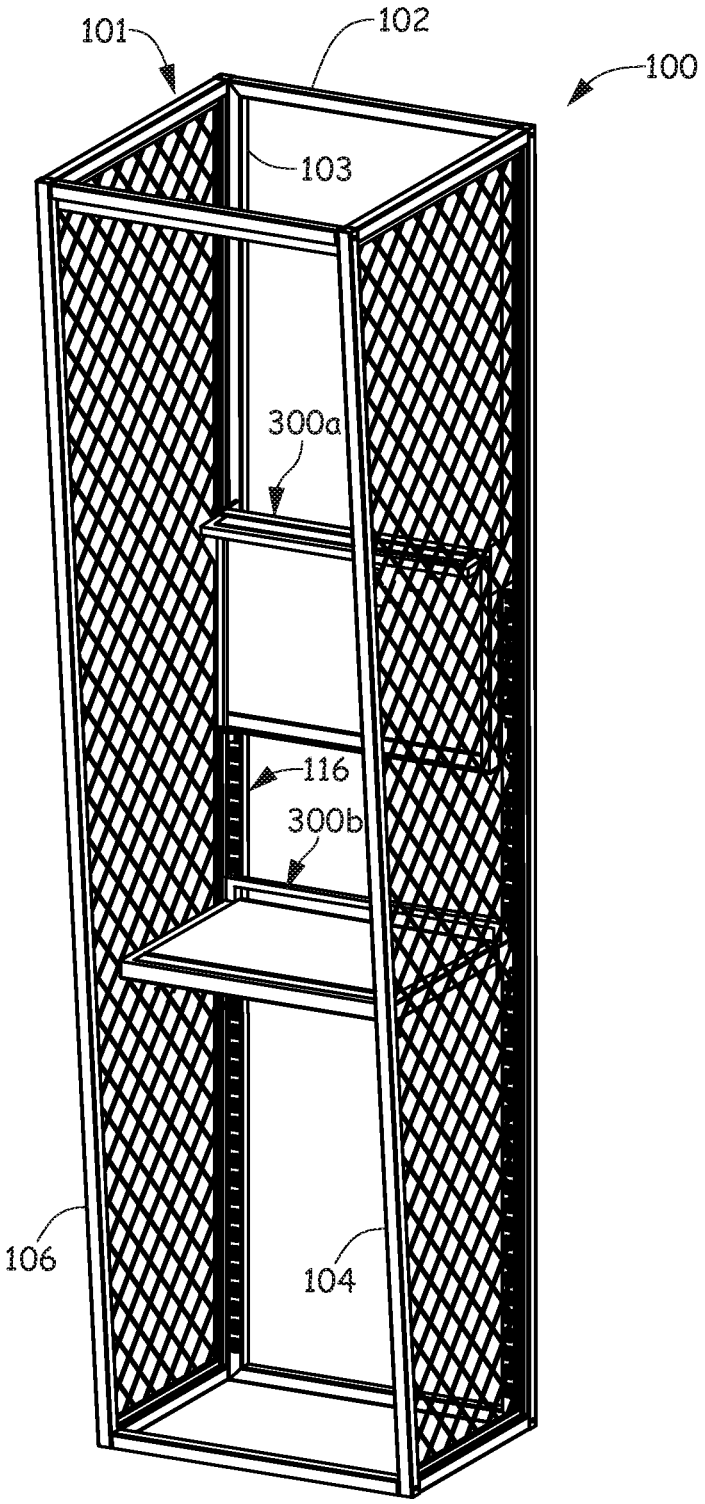
FIG. 26 is a perspective view of a pair of shelves mounted inside the tower assembly illustrated in FIGS. 1-9 according to an embodiment.

FIG. 26 is a perspective view of a pair of shelves 300*a* and 300*b* mounted inside tower assembly 101 according to an embodiment. It should be realized that a pair of rotatable shelves, such as rotatable shelf 200, could in the alternative be mounted inside tower assembly 100. In particular, shelves 300*a* and 300*b* are mounted inside tower assembly 100 by mating each of their pair of brackets 342 and 344 with the front facing slots 116 of vertical components 103 and 105 of back frame 102. However, before mounting shelves 300*a* and 300*b* inside tower assembly 101, tower assembly 101 is mounted to a gondola display fixture using cross bar 120 as shown in FIGS. 5-9.

Figure 27:
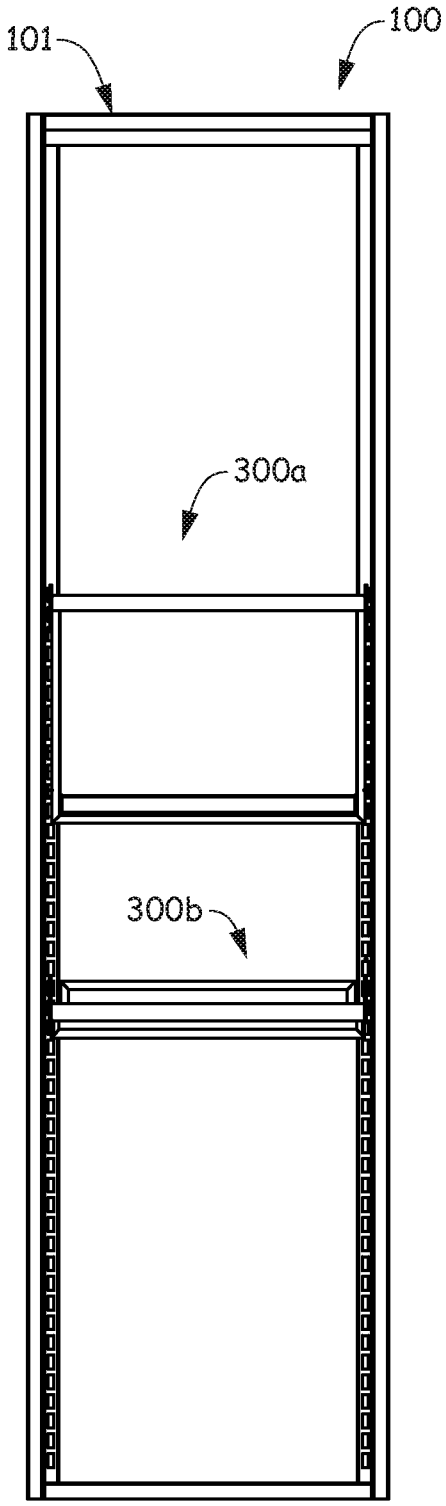
FIG. 27 is a front view of FIG. 26.
Figure 28:
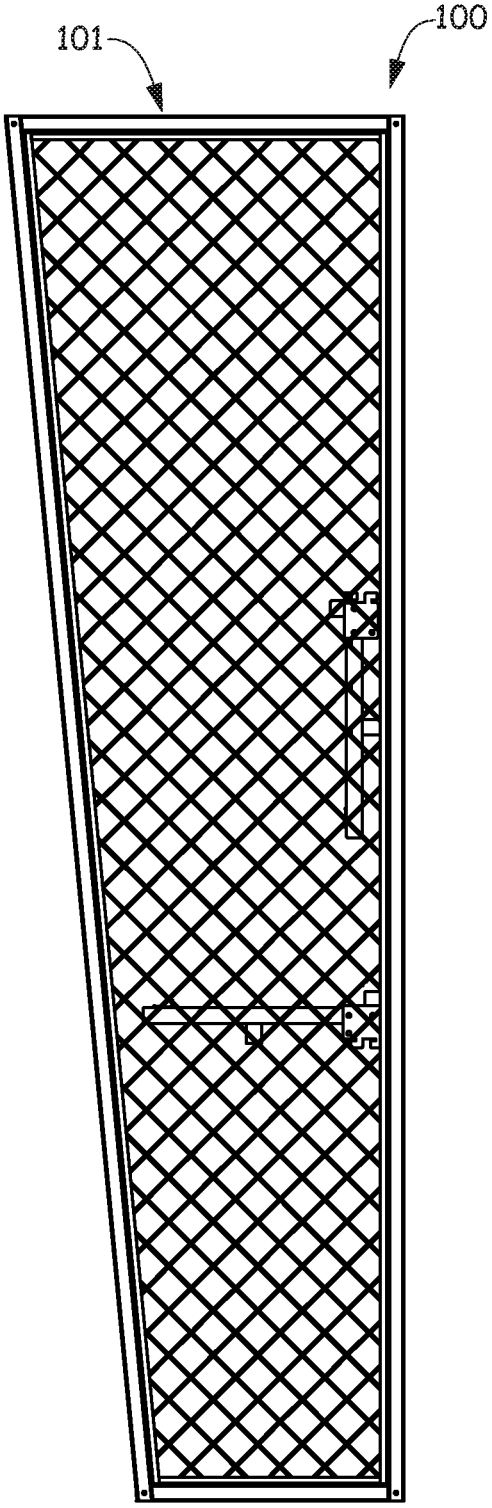
FIG. 28 is a right side view of FIG. 26.

FIG. 27 is a front view of FIG. 26 and FIG. 28 is a right side view of FIG. 26. In FIGS. 26-28, upper shelf 300*a* is oriented in the second orientation and lower shelf 300*b* is oriented in the first orientation. It should be realized that any number of shelves 300 may be mounted to tower assembly 101 and the shelves 300 that are mounted to display structure 100 may be in either the first or the second orientation. For example, in FIGS. 26-28, upper shelf 300*a* may include a saddle mount face out bar that supports hanging merchandise along a forward direction from back frame 102 of display unit 100 towards the customer or guest, while lower shelf 300*b* may support hanging merchandise between right side angled frame 104 and left side angled frame 106 of display unit 100

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display unit comprising:

at least one shelf including a first side, an opposing second side and a pair of brackets, the at least one shelf being configured in a first orientation and configured in a second orientation; and at least one hang bar mounted to and protruding from the first side or the second side of the at least one shelf, the hang bar including an elongated member, a first end member extending from a first end of the elongated member and a second end member extending from a second end of the elongated member, wherein the elongated member extends widthwise across at least a portion of the at least one shelf and is spaced apart from the first side or the second side of the at least one shelf by the first and second members;

wherein in the first orientation the pair of brackets are configured to orient the first side to face in an upward direction and the opposing second side to face in a downward direction; and wherein in the second orientation the pair of brackets are configured to orient the first side to face in a forward direction and the opposing second side to face in a backward direction.

2. The display unit of claim 1, wherein the at least one hang bar comprises a first hang bar that is mounted to and protrudes from the first side of the shelf, wherein in the first orientation the first hang bar protrudes in the upward direction and wherein in the second orientation the first hang bar protrudes in the forward direction.

3. The display unit of claim 2, wherein the at least one hang bar comprises a second hang bar that is mounted to and protrudes from the second side of the shelf, wherein in the first orientation the second hang bar protrudes in the downward direction and wherein in the second orientation the second hang bar protrudes in the backward direction.

4. The display unit of claim 3, wherein in the first orientation the at least one shelf is configured to display merchandise resting on the first side of the base and is configured to display hanging merchandise on the second hang bar that protrudes in the downward direction from the second side.

5. The display unit of claim 3, wherein in the second orientation the at least one shelf is configured to display hanging merchandise on the first hang bar that protrudes in the forward direction from the first side.

6. The display unit of claim 1, further comprising a tower assembly including a back frame having a pair of vertical components with a plurality of front facing slots.

7. The display unit of claim 6, wherein the pair of brackets of the at least one shelf mounts the at least one shelf to the pair of vertical components using the plurality of front facing slots, wherein each of the pair of brackets include a first set of hooks configured to mount the at least one shelf in the first orientation and a second set of hooks configured to mount the at least one shelf in the second orientation.

8. The display unit of claim 6, wherein the tower assembly comprises a right side angled frame fastened to a right vertical component of the pair of vertical components and a left side angled frame fastened to a left vertical component of the pair of vertical components, the right and left side angled frames have a depth dimension at their tops that is greater than a depth dimension at their bottoms.

9. The display unit of claim 8, wherein each of the right and left side angled frames comprise a mesh weldment extending from the tops of the right and left side angled frames to the bottoms of the right and left side angled frames.

10. A display unit comprising:

at least one shelf including a first side, an opposing second side and a pair of brackets; at least one hang bar mounted to and protruding from the first side or the second side of the at least one shelf, the at least one hang bar including an elongated member, a first end member extending from a first end of the elongated member and a second end member extending from a second end of the elongated member, wherein the elongated member extends widthwise across at least a portion of the at least one shelf and is spaced apart from the first side or the second side of the at least one shelf by the first and second members;

a tower assembly including a back frame having a pair of vertical components with a plurality of front facing slots and a pair of right and left side angled frames coupled to the back frame; and wherein the at least one shelf is mounted inside the tower assembly by mating the pair of brackets with front facing slots in the pair of vertical components; and wherein the at least one shelf is configured into a first orientation and configured into a second orientation, wherein in the first orientation the first side faces in an upward direction and the second side faces in a downward direction and wherein in the second orientation the first side faces in a forward direction and the second side faces in a backward direction.

11. The display unit of claim 10, wherein the at least one hang bar comprises a first hang bar mounted to the first side of the at least one shelf and a second hang bar mounted to the second side of the at least one shelf.

12. The display unit of claim 11, wherein in the first orientation the first hang bar protrudes from the first side in the upward direction and the second hang bar protrudes from the second side in the downward direction and wherein in the second orientation the first hang bar protrude from the first side in the forward direction and the second hang bar protrudes from the second side in the backward direction.

13. The display unit of claim 12, wherein in the first orientation the at least one shelf is configured to display merchandise resting on the first side and is configured to display hanging merchandise on the second hang bar that protrudes in the downward direction from the second side.

14. The display unit of claim 12, wherein in the second orientation the at least one shelf is configured to display hanging merchandise on the first hang bar that protrudes in the forward direction from the second side.

15. The display unit of claim 10, wherein the pair of brackets are mounted to the front facing slots in the pair of vertical components of the tower assembly and orient the at least one shelf in one of the first orientation and the second orientation, wherein each of the pair of brackets include a first set of hooks to orient the at least one shelf in the first orientation and a second set of hooks to orient the at least one shelf in the second orientation.

16. The display unit of claim 10, wherein the pair of right and left side angled frames each comprise a mesh weldment that extends from the tops of the right and left side angled frames to the bottoms of the right and left side angled frames.

17. The display unit of claim 10, wherein the tower assembly further comprises a pair of supports that mount the tower assembly to a cross bar, wherein the cross bar is configured to be mounted to a gondola display fixture.

18. A method of displaying merchandise comprising:

mounting at least one shelf inside a tower assembly, wherein the at least one shelf includes a first side, an opposing second side, a pair of brackets, and at least one hang bar that is mounted to and protrudes from the first side or the second side, wherein the tower assembly includes a back frame having a pair of vertical components with a plurality of front facing slots that receive the pair of brackets of the at least one shelf and a pair of right and left side angled frames coupled to the back frame and wherein the at least one hang bar includes an elongated member, a first end member extending from a first end of the elongated member and a second end member extending from a second end of the elongated member, the elongated member extending widthwise across at least a portion of the at least one shelf and being spaced apart from the first side or the second side of the at least one shelf by the first and second members; and configuring the at least one shelf into a first orientation and a second orientation, wherein in the first orientation the first side faces in an upward direction and the opposing second side faces in a downward direction and wherein in the second orientation the first side faces in a forward direction and the second side faces in a backward direction.

19. The method of claim 18, wherein the at least one hang bar comprises a first hang bar that protrudes from the first side and a second hang bar that protrudes from the second side.

20. The method of claim 19, wherein configuring the at least one shelf into the first orientation comprises configuring the at least one shelf to display resting merchandise on the first side and to display hanging merchandise on the second hang bar that protrudes from the second side and wherein configuring the at least one shelf into the second orientation comprises configuring the at least one shelf to display hanging merchandise on the first hang bar that protrudes from the second side.

* * * * *